United States Patent [19]

Lester et al.

[11] 4,067,279

[45] Jan. 10, 1978

[54] CRIMPER FOR BOTTLE CLOSURES

[75] Inventors: Steven W. Lester, Alhambra; John F. Cromelin, Yorba Linda; James M. Davenport, Van Nuys, all of Calif.

[73] Assignee: American Hospital Supply Corporation, Evanston, Ill.

[21] Appl. No.: 692,390

[22] Filed: June 3, 1976

[51] Int. Cl.[2] ..... B63B 9/08

[52] U.S. Cl. ..... 113/1 D; 53/334; 81/3.4; 113/121 A; 113/30

[58] Field of Search ..... 113/30, 1 D, 1 E, 1 F, 113/1 N, 121 A, 121 C; 72/74; 53/334, 331, 396, 42, 329; 81/3.4

[56] References Cited

U.S. PATENT DOCUMENTS

| | | | |
|---|---|---|---|
| 1,887,152 | 11/1932 | Geisler | 81/3.4 |
| 2,369,763 | 2/1945 | Stover et al. | 113/1 D |
| 3,569,397 | 5/1972 | Mills | 53/329 |

*Primary Examiner*—Leon Gilden

*Attorney, Agent, or Firm*—Tilton, Fallon, Lungmus & Chestnut

[57] ABSTRACT

A device for manually crimping metal caps of the type commonly used for medical solution bottles. The crimper takes the form of a generally cylindrical body dimensioned to be held in the hand and defining a cavity open at its bottom and along a portion of its side to receive the neck of a bottle upon which an uncrimped metal cap has been placed. A shoulder within the cavity bears against the skirt of the cap and, as the crimper is rotated relative to the bottle, the bottom of the skirt is turned inwardly to secure the protective cap upon the bottle neck.

12 Claims, 13 Drawing Figures

CRIMPER FOR BOTTLE CLOSURES

BACKGROUND

As is well known, a standard closure for an intravenous solution bottle consists of a stopper which is permanently secured to the bottle by a metal rim. A protective disc covers the stopper (and any membrane which extends over the stopper), and the entire assembly is then protected by a thin metal outer cap having a skirt which is crimped about the bottle neck. In use, the breakaway metal cap is removed by pulling an integral tear tab, the protective disc is discarded, and suitable attachments are made through the stopper for administering the contents of the bottle to a patient.

Prior to such administration, it may be desirable to add certain medicaments or other additives to the contents of the bottle. In such a case, the original breakaway cap and disc are removed and discarded, the additive is injected into the bottle, and a protective replacement cap, usually identical to the original breakaway cap, is fitted and crimped in place. Such caps are commercially available expressly for replacement purposes, as are crimping devices for manually crimping the skirts of those caps.

While a variety of manually-operable crimpers have been known and used in the past, such devices have generally been relatively complex in design, heavy and awkward to manipulate, and expensive to manufacture and purchase. Despite their elaborate construction, or perhaps because of it, such crimpers sometimes fail to operate properly to produce the intended results.

SUMMARY

This invention is concerned with a hand-operated crimping device of relatively uncomplicated construction and operation which overcomes all of the aforementioned defects and disadvantages of prior devices. Specifically, the crimper is composed of a minimum number of parts (in the best mode presently known, the device is molded in a single piece), is extremely simple to use, and is practically foolproof in achieving effective crimping of a replacement cap. The device is merely placed upon the neck of a bottle upon which a replacement cap has been fitted and, without changing positions of the hand or fingers, the operator simply twists the crimper wih respect to the bottle to crimp the bottom skirt of the cap. Such operation is facilitated by the tendency of the crimper to be self-seating when rotated in one direction, and to be self-disengaging when the direction of rotation is reversed.

In brief, the crimper comprises a body having top and side walls defining a cavity which is open at its bottom and along one side portion. An inturned flange along the bottom of the side wall defines a reduced opening for the cavity, such opening having a width which approximates that of a bottle neck and which is less than the diameter of a standard or conventional replacement cap. Within the cavity is a crimping shoulder which extends along one side of the cavity and which is disposed beneath the underside of the body's top wall a distance less than the height of the replacement cap. In one form of the invention the shoulder is formed integrally with the side wall of the body; in another, the shoulder takes the form of a spring element which is secured within the cavity.

Other advantages and objects of the invention will become apparent from the specification and drawings.

DRAWINGS

DESCRIPTION

Figure 1:
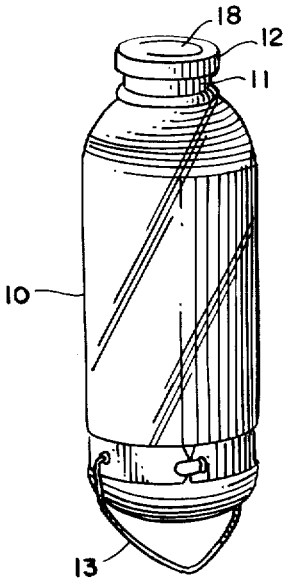
FIG. 1 is a perspective view of a conventional intravenous solution bottle.

Referring to FIG. 1, the numeral 10 designates a medical solution bottle having a reduced neck portion 11, a closure 12, and a supporting structure in the form of bail 13. Bottle 10 is typical and is presented only to illustrate a type of bottle with which the crimper of this invention may be used. The crimper may be adapted for use with any standard intravenous solution bottle on which a replacement cap would be attached by a manual crimping operation.

Figure 2:
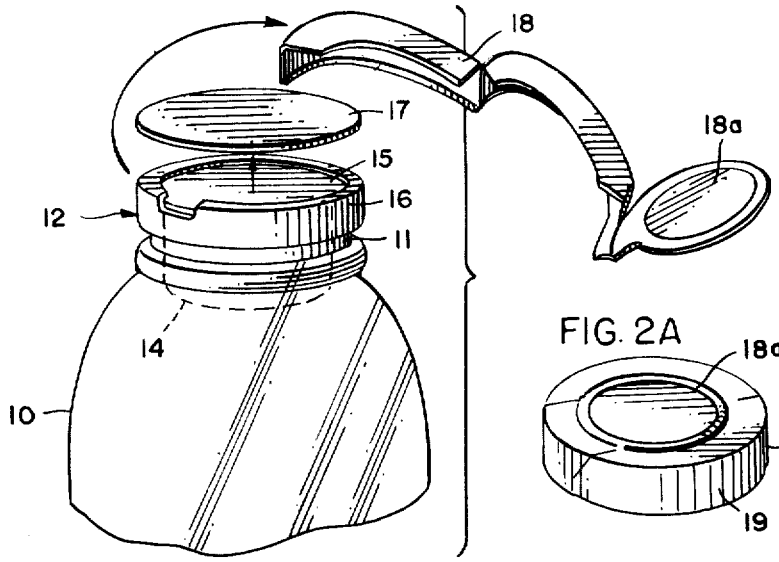
FIG. 2 is an enlarged fragmentary exploded perspective view illustrating the removal of the breakaway cap and protective disc from the bottle of FIG. 1.

In the particular construction illustrated, the closure 12 comprises a resilient stopper 14, a membrane 15, a metal rim 16 which secures the stopper in place and which also removably retains membrane 15, a protective disc 17, usually formed of metal, and a breakaway cap 18 formed of a metal, such as aluminum, which can be easily torn and removed by lifting and pulling tab **18*a*. Among its functions the outer cap serves as an indication of tamperproofness. When the contents of the bottle are to be administered, the protective outer cap 18 is broken away as illustrated in FIG. 2, disc 17 is discarded and an administration set (not shown) is inserted into and through stopper 14**, all as well-known in the art.

Figure 2A:
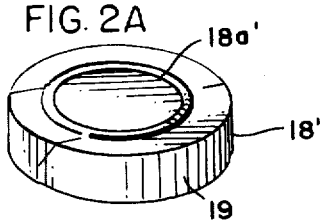
FIG. 2A is a perspective view of a standard uncrimped replacement cap.

As previously indicated, there are times when a suitable medicant is to be added to bottle 10 prior to administration of its contents. The additive may be introduced hours before administration and at a point quite remote from the patient and, therefore, some means must be provided for protecting the remaining closure elements of the bottle during the interval before administration. Such means takes the form of a standard replacement cap 18' (FIG. 2A) which is identical to original cap 18 except that, as shown, its skirt portion is uncrimped. This invention is concerned with an improved device for crimping the lower portion of that skirt after replacement cap 18' has been fitted upon the neck of a bottle.

The crimping device 20 illustrated in FIGS. 3–7 takes the form of a generally cylindrical body 21 having a top wall 22 and a side wall 23. The top and side walls define a cavity 24 which is open at its bottom and along one side portion of the body. Specifically, the cavity-defining surface of the side wall 23 is generally U-shaped in configuration, having an arcuate intermediate portion **23*a* and a pair of relatively straight side portions 23*b*. The side opening or mouth 25 of the body is defined by the free ends of side portions 23*b***.

Figure 8:
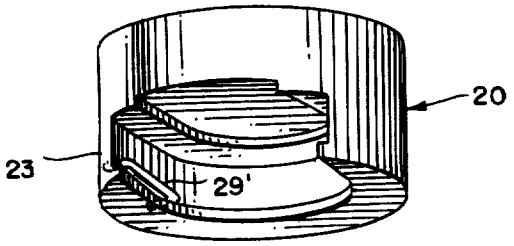
FIG. 8 is a perspective view of a crimper constituting a second embodiment of this invention.
Figure 9:
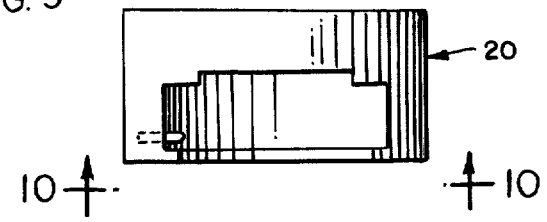
FIG. 9 is a front elevational view of the crimper of FIG. 8.
Figure 10:
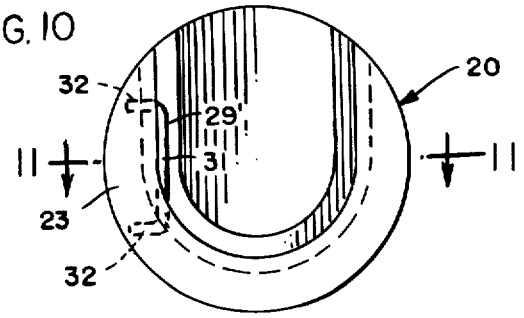
FIG. 10 is a bottom view taken along line 10—10 of FIG. 9.
Figure 11A:
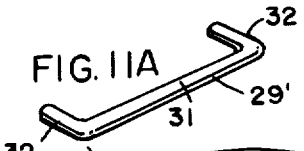
FIG. 11A is a perspective view of the spring element illustrated in FIG. 11 and in FIGS. 8–10.
Figure 11:
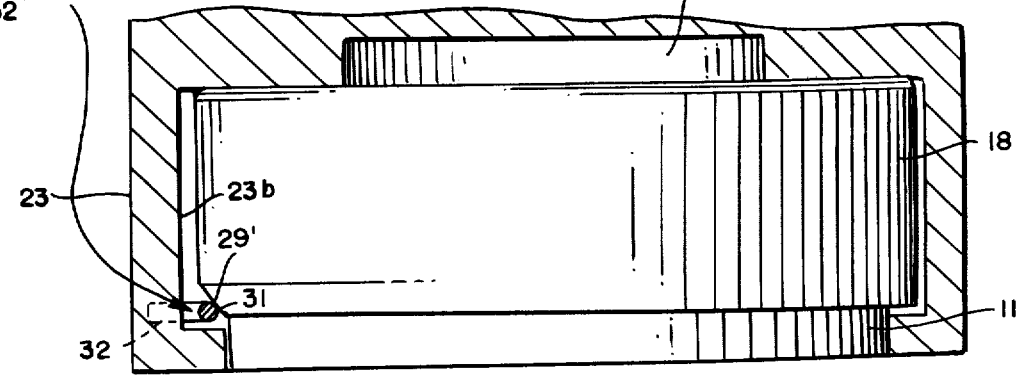
FIG. 11 is an enlarged fragmentary view taken along line 11—11 of FIG. 10 and illustrating the crimper in relation to a bottle and bottle cap.

It will be noted that the top wall 23 is internally stepped to define a recess 26 for accommodating the pull tab **18*a*' of the replacement cap. Because of its size, the recess 26 will receive the pull tab of the cap even if for some reason the tab has been partially lifted. It is to be understood that, if desired, the height of recess 26 may be reduced from that shown (compare, for example, the reduced recess shown in FIGS. 8 and 9), and that, in any event, the primary undersurface of the top wall 22 is the surface designated in the drawings by numeral 22*a***.

The distance between side wall portions **23*b* is slightly greater than the outside diameter of standard replacement cap 18'. At its bottom, the side wall 23 is provided with an inturned flange 28. In the illustration given, the flange extends the full extent of side wall 23 although, if desired, the flange may be interrupted at one or more points without significantly altering the operation of the structure. The opening defined by the inturned flange 28 is smaller than replacement cap 18'. Preferably, the opening defined by the flange is the same size, or only slightly larger, than the diameter of bottle neck 11. The distance between flange 28 and the undersurface 22*a* of top wall 22 is the same as, or preferably just slightly greater than, the full height of skirt 19 of the uncrimped cap 18'**.

Figure 3:
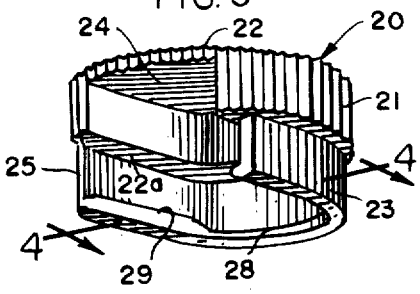
FIG. 3 is a perspective view of a crimper embodying the present invention.
Figure 4:
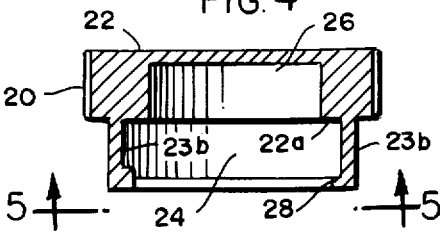
FIG. 4 is a sectional view taken along line 4—4 of FIG. 3.
Figure 5:
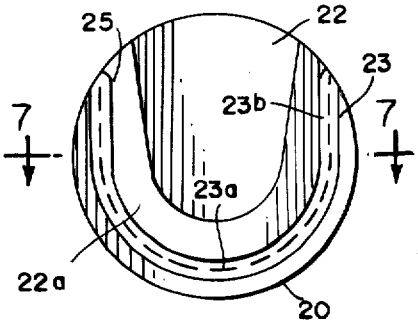
FIG. 5 is a bottom view taken along line 5—5 of FIG. 4.
Figure 6:
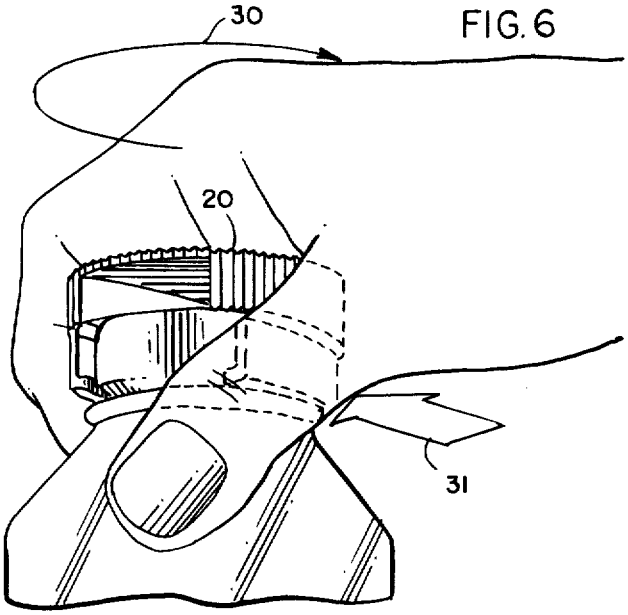
FIG. 6 is a fragmentary perspective view illustrating the method of use of the crimper.
Figure 7:
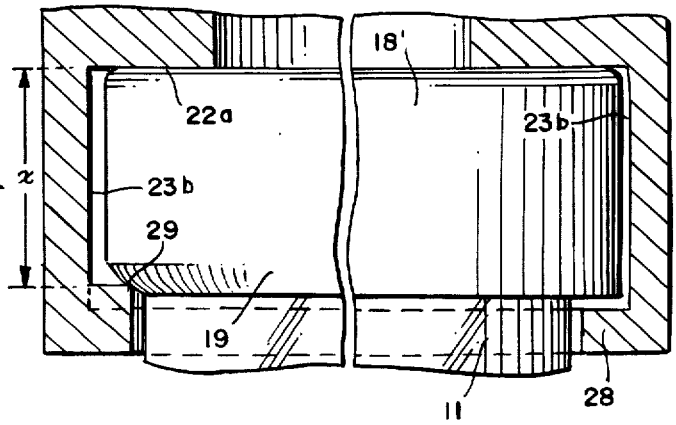
FIG. 7 is an enlarged fragmentary sectional view taken along line 7—7 but illustrating the crimper in conjunction with a bottle cap during a crimping operation.

As illustrated most clearly in FIGS. 3 and 7, a crimping shoulder 29 extends along one side of the cavity at a level above the upper surface of flange 28. The distance *x* between the shoulder and the top surface **22*a* is less than the height of the uncrimped cap 18'. Therefore, when a cap is fitted upon the neck of a bottle and is then inserted into the cavity of the crimper through the mouth or side opening 25 thereof, shoulder 29 will cause a small portion of the circumference of the cap's skirt 19 to be crimped inwardly as full entry of the cap into the cavity is achieved (FIG. 7). Thereafter, holding the cap as illustrated in FIG. 6 and rotating the bottle and crimper relative to each other as represented by arrows 30 and 31, shoulder 29** is advanced along the full perimeter of the cap to crimp the bottom of the skirt inwardly about its entire circumference.

Rotation of the bottle in a counterclockwise direction relative to crimper 20 tends to cause the bottle to remain within the cavity, whereas rotation in the opposite direction tends to cause the capped neck of the bottle to roll out of the cavity, the reason being that the greatest frictional resistance to rotation occurs between shoulder 29 and that portion of the cap which is engaged by the shoulder. Since the shoulder is located along the left wall portion **23*b* of the crimper body (when the crimper is viewed from its open side), frictional resistance during clockwise rotation of the crimper (when viewed from above) has the effect of insuring that the parts will remain in proper positions throughout the entire crimping operation. If, on the other hand, it is desired to construct a crimper which would perform its crimping operation when rotated in a counterclockwise direction (when viewed from above) then shoulder 29 should be located on just the opposite side of the cavity (i.e., on the right side when viewed as in FIG. 7**).

The embodiment of FIGS. 8–11 is similar to the construction already described, the main difference being that shoulder 29' takes the form of a spring element instead of being an integrally-formed enlargement of the crimper body. The spring element has an intermediate portion 31 and a pair of end portions 32 turned at substantially right angles to the intermediate portion. The end portions may be embedded in the side wall **23*b* of the crimper body, as shown most clearly in FIGS. 10 and 11, and the intermediate portion 31 is spaced inwardly from the inside surface of side wall 23*b* to permit limited lateral flexure during a crimping operation. The spring element 29', which is preferaly formed of spring metal, is therefore capable of performing a cushioning operation to accomodate slight dimensional differences or irregularities in the bottles with which the crimper is used. It is to be noted, however, that in the embodiment of FIGS. 1–10** a similar but perhaps less pronounced cushioning action also occurs by reason of the flexing of the plastic side walls.

Although there are slight differences in configuration and dimension, the two embodiments are otherwise substantially the same in structure and operation. In both constructions, the crimper bodies are preferably formed from rigid plastic such as, for example, nylon or acetal.

While in the foregoing we have disclosed embodiments of the invention in considerable detail for purposes of illustration, it will be understood by those skilled in the art that many of these details may be varied without departing from the spirit and scope of the invention.

We claim:

1. A device for crimping inwardly the cylindrical skirt of an outer protective replacement cap for a conventional solution bottle, said bottle having a neck of predetermined outside diameter and said skirt being of predetermined height and diameter, wherein said device comprises a body having top and side walls defining a cavity open at its bottom and one side thereof, said cavity being of a width adapted for closely and rotatably receiving the replacement cap for a solution bottle, an inturned flange along the bottom of said side wall defining a reduced bottom opening for said cavity, said reduced opening having a width adapted to receive the neck of such solution bottle and substantially less than the width of said cavity, and a crimping shoulder extending inwardly into said cavity along a portion of said side wall above the level of said flange, said shoulder being adapted to engage the lower portion of the skirt of such replacement cap for crimping the same inwardly as said device is rotated relative to the solution bottle.

2. The device of claim 1 in which said shoulder is formed integrally with said side wall.

3. The device of claim 2 in which said body is formed of one piece of rigid plastic.

4. the device of claim 1 in which said shoulder comprises a spring element secured to said body above said flange along one side of said cavity.

5. The device of claim 4 in which said spring element is formed of metal.

6. The device of claim 1 in which the surface of said side wall defining said cavity is generally U-shaped in configuration.

7. The device of claim 6 in which said U-shaped surface includes an arcuate portion with a curvature adapted to conform with the curvature of the cylindrical skirt of said cap.

8. The device of claim 6 in which said U-shaped surface has an arcuate portion joined by a pair of relatively straight side portions, said crimping shoulder being disposed along one of said straight side portions adjacent the side opening of said cavity.

9. The device of claim 8 in which the bottom of said top wall is provided with a recess communicating with said opening at said one side, said recess having a width less than the distance between said side portions.

10. The device of claim 8 in which said shoulder is formed integrally with said side wall.

11. The device of claim 8 in which said shoulder comprises a spring element secured to said body above said flange along one side of said cavity.

12. The device of claim 1 in which said body is generally cylindrical in outer configuration.

* * * * *